US011932457B1

(12) United States Patent
Kasdon

(10) Patent No.: US 11,932,457 B1
(45) Date of Patent: Mar. 19, 2024

(54) CONTAINER CLOSURE SYSTEMS

(71) Applicant: William Kasdon, Gloucester, MA (US)

(72) Inventor: William Kasdon, Gloucester, MA (US)

( * ) Notice: Subject to any disclaimer, the term of this patent is extended or adjusted under 35 U.S.C. 154(b) by 0 days.

(21) Appl. No.: 18/338,625

(22) Filed: Jun. 21, 2023

(51) Int. Cl.
*B65D 43/12* (2006.01)
*B65D 25/28* (2006.01)

(52) U.S. Cl.
CPC ..... *B65D 43/12* (2013.01); *B65D 25/2808* (2013.01); *B65D 2543/00194* (2013.01); *B65D 2543/0049* (2013.01); *B65D 2543/00546* (2013.01); *B65D 2543/00842* (2013.01); *B65D 2543/00953* (2013.01)

(58) Field of Classification Search
CPC ..... B65D 43/12; B65D 2543/0049; B65D 2543/00546; B65D 2543/00842; B65D 2543/00953; B65D 25/2808; B65D 2543/00194
See application file for complete search history.

(56) References Cited

U.S. PATENT DOCUMENTS

| | | | | |
|---|---|---|---|---|
| 955,516 | A | 4/1910 | Jordan | |
| 1,482,383 | A | 2/1924 | Martin et al. | |
| 2,248,719 | A | 7/1941 | Owen | |
| 2,587,200 | A | 2/1952 | Nottingham | |
| 2,740,175 | A | 4/1956 | Eaddy, Sr. | |
| 3,072,977 | A | 1/1963 | Burda | |
| 3,362,564 | A | 1/1968 | Mueller | |
| 3,416,259 | A | 12/1968 | Kogan | |
| 4,406,088 | A | 9/1983 | Berndt, Jr. | |
| 4,805,345 | A | 2/1989 | Ohi | |
| 5,237,776 | A | 8/1993 | Kubota | |
| 5,775,579 | A | 7/1998 | Kardum et al. | |
| 5,884,779 | A | 3/1999 | Rich | |
| 6,082,047 | A | 7/2000 | Comaglio et al. | |
| 6,195,939 | B1 | 3/2001 | Sowers | |
| 6,364,154 | B2 | 4/2002 | Kruzick et al. | |
| 6,826,867 | B1 | 12/2004 | McDonald et al. | |
| 7,124,538 | B1 | 10/2006 | Kline | |
| 2006/0138145 | A1* | 6/2006 | Toth | B65D 50/04 220/345.2 |
| 2013/0320017 | A1* | 12/2013 | Kientzle | B65D 47/286 220/345.3 |

(Continued)

FOREIGN PATENT DOCUMENTS

| | | | |
|---|---|---|---|
| DE | 846 785 | C | 8/1952 |
| FR | 841952 | A | 6/1939 |

(Continued)

*Primary Examiner* — Shawn M Braden
(74) *Attorney, Agent, or Firm* — Wolf, Greenfield & Sacks, P.C.

(57) ABSTRACT

A container system may include a vessel with a cavity for storing foodstuff and/or small items, and a cover for sealing the contents of the vessel. The cover may be reconfigurable from a first configuration to be transversely slid along a channel formed on an upper edge of the vessel and a second configuration to seal the vessel when positioned over the cavity. The cover may include a lid and an actuator to reconfigure the cover. The actuator may include an actuator plate and a plurality of struts arranged between the actuator plate and the lid. When the lid is positioned over the cavity, the actuator plate may be urged in a vertically upward direction relative to the vessel by the struts, to seal the lid against the vessel.

15 Claims, 13 Drawing Sheets

(56) References Cited

U.S. PATENT DOCUMENTS

| | | | | |
|---|---|---|---|---|
| 2016/0297580 | A1* | 10/2016 | Batzel | B65D 21/0204 |
| 2017/0225844 | A1 | 8/2017 | Prakailerdluk | |
| 2018/0044062 | A1 | 2/2018 | Smith | |
| 2018/0356148 | A1 | 12/2018 | Fei et al. | |
| 2020/0165055 | A1* | 5/2020 | Barfoot | B65D 43/164 |
| 2021/0269201 | A1* | 9/2021 | Batzel | B65D 43/20 |

FOREIGN PATENT DOCUMENTS

| | | | |
|---|---|---|---|
| FR | 2 548 257 | A1 | 1/1985 |
| GB | 274376 | A | 7/1927 |

* cited by examiner

CONTAINER CLOSURE SYSTEMS

FIELD

Disclosed embodiments are related to container systems and related methods of use. More specifically, methods and systems related to accessible container closure systems are disclosed.

BACKGROUND

Conventional containers for food and item storage typically include a two-part assembly of a container vessel and a lid to help preserve or contain the contents of the vessel. In some cases, the lid can be sealed on the vessel to reduce the flow of fluid (e.g., air) into the container to help reduce bacterial growth and/or dust coverage.

SUMMARY

In some embodiments, container systems are disclosed. A container system may include a vessel and a cover. The vessel has an internal cavity formed by a plurality of sidewalls, and includes a top edge along at least some of the plurality of sidewalls. The cover is configured to be slidably received along the top edge of the vessel. The cover may be configured to transition between a first configuration and a second configuration to seal the cover against the vessel, wherein the cover has a first height in the first configuration and a second height in the second configuration, the first height being less than the second height.

In other embodiments, methods of sealing a container system are disclosed. Methods of sealing may involve a container system including a vessel and a cover. The method may comprise acts of positioning the cover of the container system to overlie at least a portion of the vessel of the container system, applying a first force to the cover in a first direction, and converting the first force into a second force which is transverse to the first force to seal the cover against the vessel.

In other embodiments, methods of sealing a container system are disclosed. Methods of sealing may involve a container system which includes a cover and a vessel. The vessel includes a channel configured to receive the cover. The channel is arranged at a top edge of at least some of a plurality of sidewalls of the vessel and extends in a longitudinal direction. The method may comprise acts of: inserting the cover into the channel of the vessel, and transitioning the cover from a first configuration having a first height to a second configuration having a second height to seal the cover against the vessel, wherein the first height of the cover in the first configuration is less than the second height of the cover in the second configuration.

In other embodiments, container systems are disclosed. A container system may include a vessel and a cover. The vessel has an internal cavity formed by a plurality of sidewalls, and includes a top edge along at least some of the plurality of sidewalls. The cover is configured to be transversely slidably received along the top edge of the vessel. The cover is configured to transition between a first configuration and a second configuration in response to the transverse movement of the cover along the top edge of the vessel to seal the cover against the vessel.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

Figure 1:
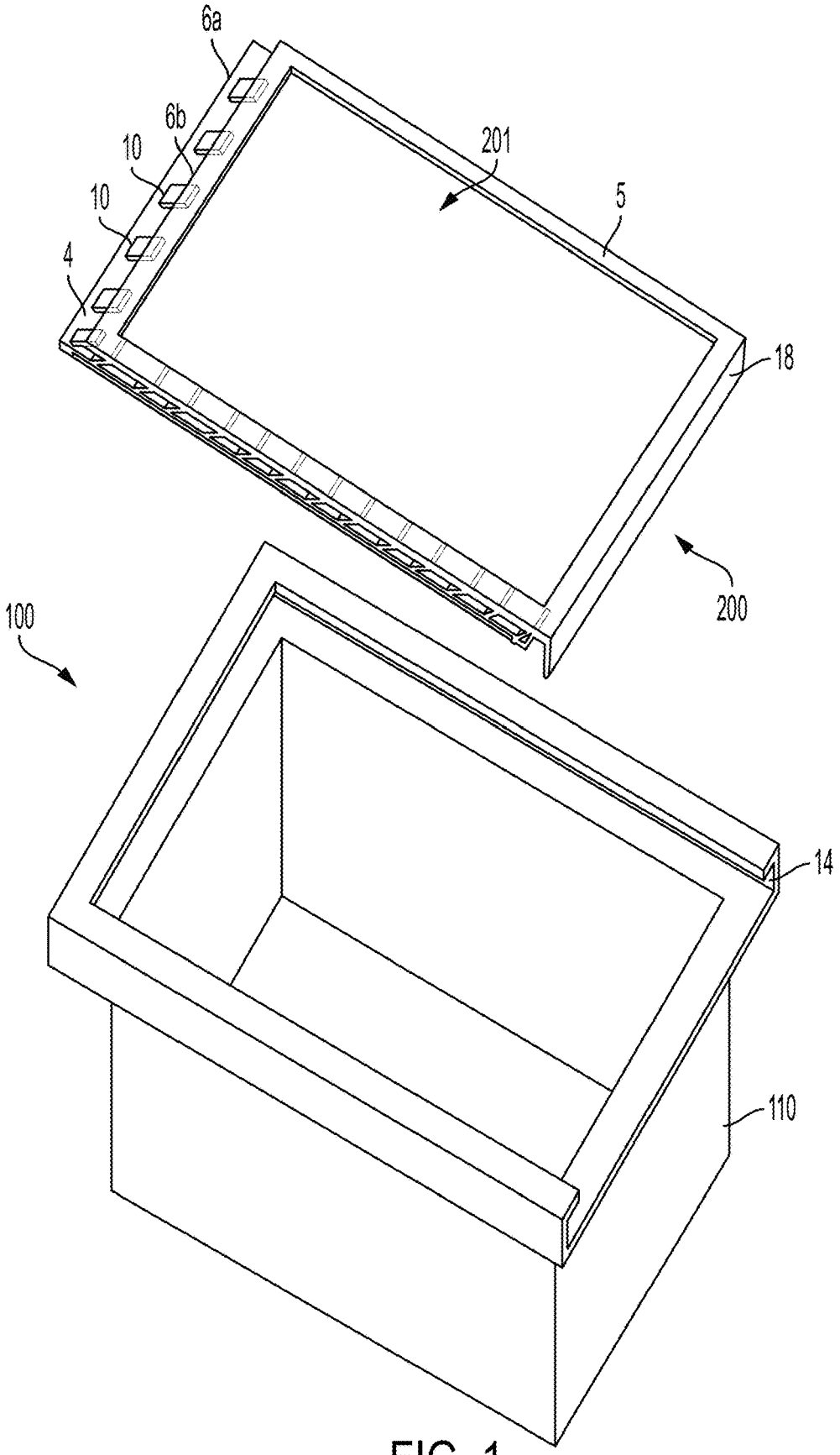
FIG. 1 shows an exploded view of a container according to some embodiments.

In conventional container storage systems, a lid can be secured to a vessel through friction, for example, by fitting a channel on the lid to an upper lip of the vessel. The upper lip of the vessel may include a raised rim or ridge which is inserted into the channel of the lid. The lid may be aligned with the vessel and pressed down to ensure engagement between the two components. In some cases, the lid can include hinged latches arranged on the peripheral outer portion of the lid. The latches may have hook features which engage a lip portion of the vessel when the lid is aligned with the vessel. The latch hook features may be rotated about a living hinge to move between a latched and unlatched position to help secure the lid to the base. In some instances, the latch features may require significant force to overcome the snug fit between the vessel and the lid.

The Inventor has appreciated that conventional container systems typically require two-handed operation for alignment and securement of the lid to the vessel. In some instances, the operation may require consistent, considerable, and directed force from the user. However, the Inventor has appreciated that users with limited strength (e.g., arthritic users, elderly users, children, disabled users) may not be able to effectively achieve lid/vessel closure and opening. Furthermore, users with temporary disability, such as users who may be holding an infant or a pet while trying to operate a container, or those with temporarily broken or dysfunctional limbs, may also suffer complications. In particular, removing lids from conventional vessels may require significant force and oriented force, which can be particularly challenging for certain users. Given the universal use of containers in everyday life, these limitations may greatly affect the quality of life for such users.

In view of the foregoing, the Inventor has recognized a need for a container system which may be effectively sealed with limited force and dexterity to allow for more widespread use of container systems among all users, regardless of hand function. The container system may be able to be operated with only one hand. In some cases, the container may be opened partially without having to completely remove the lid from the vessel, and therefore not needing to find additional space to rest the lid. The container may also provide tactile feedback during operation to notify the user of the state of the lid relative to the vessel (e.g., sealed, open).

In some embodiments, a container system may include a vessel and a cover to seal the vessel. The vessel may include a bottom wall and one or more sidewalls extending upwardly from the bottom wall to form an internal cavity within which food or small items (and/or any other suitable materials fit for a container) may be stored. The vessel may include one or more channels which are configured to receive the cover. The channels may be integrally molded to two or more of the vessel sidewalls. In some embodiments, the container system may be arranged so that the cover may be longitudinally slid into and along the channel of the vessel to overlie the internal cavity and help seal the contents of the vessel.

In some embodiments, the container system may facilitate sealing of a container cover to a container vessel without significant force or dexterity needed from the user. The container system may transform the transverse movement (e.g., sliding along the vessel channel) of the cover relative to the vessel into a vertical sealing of the cover to the vessel. In some embodiments, a user may actuate the cover in a first direction, which may result in the cover sealing against the vessel in a second direction. Accordingly, a user may be able to seal and unseal the cover from the vessel through low force sliding movements without complex multi-dimensional manipulation of the cover, as is typical of many conventional container systems.

In some embodiments, the cover of the container system may have an adjustable height, such that transverse movement of the cover relative to the vessel may result in a change in the cover height. As the cover is transversely displaced along the vessel channel, the height of the cover may change depending on its position relative to the channel length. Once the cover is arranged at a predetermined location, the height of the cover may increase, filling the channel height, and thereby sealing the vessel. The transverse movement (e.g., sliding) may serve to change the cover height, thereby applying a sealing pressure to the vessel. In some embodiments, the sliding of the cover relative to the vessel may result in an increase of the cover height, which may apply a downward, sealing pressure to an interface between the cover and the vessel. The interface may include a body for facilitating sealing between the two components, such as a rubber gasket.

As will be described in greater detail below, in some embodiments, the cover of the container system may include a container lid and an actuator, which may include an actuator plate parallel to the lid and a plurality of struts coupled to the actuator plate and the lid. In some embodiments, the struts may be hingedly connected to both the lid and the actuator plate.

In some embodiments, the conversion between transverse and vertical or between the first and second directions may be achieved through the use of an actuator and lid of the cover. In some embodiments, the cover may include a lid configured to seal against an upper rim of the container vessel, which may represent the lower surface of the channel. The actuator may be operable by the user and may facilitate the conversion of sliding forces to sealing forces. In some embodiments, the actuator may include a plate and struts arranged parallel to one another and hinged at attachment points on the lid and the plate of the actuator. The struts may be arranged around a periphery of the interface between the plate of the actuator and the lid. The cover may include a central portion which may be transparent and may allow the user to observe the contents of the vessel, akin to conventional container systems. As will be described in greater detail below, in some embodiments, the struts of the actuator may move uniformly in a plane perpendicular to the plane of travel of the actuator plate.

When sliding the cover into the channel of the vessel to seal the container system, the struts may be arranged in a first configuration, wherein the struts may be arranged in a low profile between the lid and the actuator plate of the cover. In some embodiments, the struts may be configured to lie parallel to the lid and actuator plate during insertion of the cover into the channel of the vessel. In other embodiments still, the struts may lie at an angle relative to the lid and actuator plate. The struts may be arranged in any suitable manner to reduce the profile of the cover and the channel to permit movement of the cover along the vessel channel without significant friction from the channel. Accordingly, the height of the cover at its first configuration may be less than the height of the channel of the vessel.

In some embodiments, the struts may be coupled to the lid and the actuator plate of the cover through a living hinge configuration. Thus, the struts may include flexible (e.g., rotatable) connections to various positions along the lid and the actuator plate. The struts may also include a relatively rigid, inflexible beam-like body arranged between the flexible connections. The beam-like body of the struts may be rigid enough to achieve the force conversion between a transverse force applied by the user, and a vertical force needed to seal the lid to the container vessel. In some embodiments, the beam-like body of the struts may have a flat rectangular configuration. In other embodiments, the beam-like body of the struts may be cylindrical. It should be appreciated that any suitable geometry of beam-like bodies of the struts may be employed to achieve the aforementioned force conversion of the container.

In other embodiments, the beam-like body of the struts may be flexible about an axial direction of the beam-like body. Accordingly, instead of (or in addition to) the beam-like body of the struts rotating around the hinged connections with the actuator plate and lid, the beam-like body of the struts may elastically deform to achieve the various heights of the cover to seal the container vessel. In some embodiments, the beam-like bodies may be sufficiently flexible to both extend between their hinged connections and elastically buckle. Accordingly, the struts may enable the sealing process of the cover through compressive and extensive forces, rather than through the living hinge arrangement described previously.

In some embodiments, beam-like bodies of the struts may be hingedly connected to the actuator plate and lid through pinned connections, or alternatively, may be slidably coupled to one or more or the actuator plate and lid through roller-type connections. In some embodiments, the struts may include damper-type bodies connected between one or more roller-type connections with the actuator plate and lid. Such damper-type bodies may enable the sealing process of the cover through a dashpot mechanism which may achieve extension and compression without significant elasticity. For example, the damper-type bodies of the struts may include a plunger arranged in a body of viscous fluid, allowing the plunger to axially move along the body without elastically extending or contracting along its axial direction.

In some embodiments, the cover may be configured to be continuously slid along the channel of the vessel until the end of its travel, at which point the lid may abut against or mate with a portion of the vessel. With continued force applied to the cover, the actuator plate may not abut against any structure of the vessel prior to sealing, and may therefore continue its travel, thereby urging the struts to rise to transition from the first configuration into a second configuration, causing the actuator plate to rise and move vertically away from the lid and change the height of the cover. In some embodiments, the height of the cover may increase to be closer to the height of the vessel channel, so that the actuator plate engages an upper portion of the channel and generates a force which urges the lid against the vessel with sufficient pressure to seal the container. In some embodiments, once the actuator plate is arranged at the end of its travel, the upper surface of the actuator plate may engage the upper walls of the channel, applying an axial compressive force to the struts, which may be transferred to the lid to help seal the cover against the channel.

In some embodiments, a gasket may be positioned between the lid and the vessel to facilitate sealing of the vessel. For example, and without limitation, the gasket may be arranged at a bottom surface of the lid. The gasket, which may be formed of an compressible material (e.g., rubber or silicone), may facilitate sealing of the vessel with the cover. It should be appreciated that in some embodiments, the gasket may be formed as part of the vessel channel. For example, the gasket may be arranged as part of an inner bottom surface of the vessel channel. In other embodiments, the container system may not include any gaskets, and may instead achieve sealing through resilient or flexible struts of the actuator.

In some embodiments, the cover may be configured so that the leading edge of the actuator plate may reach the end of the channel after the maximal compression occurs between the cover and the vessel. In other words, the leading edge of the actuator plate may not abut against the vessel until after the lid has reached the back wall of the container. The actuator plate may therefore stop its travel as it abuts against the vessel beyond the maximum compression configuration of the cover. Such an arrangement may serve to lock the cover in place and reduce the risk of the cover sliding out of the vessel channel without applying an intentional pulling force to remove the cover. It should be appreciated that although a perpendicular configuration of the struts may be the maximal compression configuration of the cover, this configuration may present a relatively unstable equilibrium state, such that even a gentle retraction force may release the system from its compressed configuration and unseal the cover. Furthermore, this locking arrangement may provide tactile feedback to the user that the cover has effectively sealed the vessel. In one embodiment, an over center arrangement may be employed to seal and unseal the cover relative to the vessel.

In some embodiments, the cover may be locked in the vessel channel through single handed operation. For example, a user may grasp a handle portion of the cover, which may be coupled to the lid, with their fingers while simultaneously applying pressure to the trailing end of the actuator plate with their thumb. It should be appreciated that the handle may be arranged on any suitable portion of the container system, such as the cover, the actuator plate, the vessel, and combinations thereof (e.g., handles on both of the cover and the actuator plate). In some embodiments, the cover may be slid forward in the vessel channel through supination of the forearm, wherein a user may grasp a handle arranged on the trailing end of the vessel with fingers extending through the handle opening from underneath, and applying counterpressure to the actuator plate handle with the thumb. Similarly, extraction of the cover from the vessel channel may require pronation of the forearm, wherein a user may place their fingers through a handle on the actuator plate from above and apply counterpressure to the vessel handle with their thumb.

In some embodiments, it may be desirable to provide intermediate locking positions for the lid relative to the vessel. For example, it may be desirable to allow the user to leave the cover within the channel of an open vessel, without risking the lid sliding off or otherwise disengaging from the vessel. For example, the user may need to access the contents of the container, and may not have sufficient counter space to place a completely disengaged cover. Accordingly, in some embodiments, there may be one or more lateral protrusions in one or more of the edges of the actuator plate corresponding with one or more lateral depressions in the vessel channel. As the cover is slid along the vessel channel, the interaction between such depressions and protrusions may minimally disrupt the sliding motion. In some embodiments, the cover may be lightly locked in place at any of the lateral depressions, allowing the user to hold the cover in an open position relative to the vessel.

In some embodiments, once the lid reaches the end of the vessel channel, the actuator plate may continue its travel, causing the struts to rise, rotating on their hinges reciprocally at their attachment points to the lid and the actuator plate. In some embodiments, the struts may be arranged perpendicular to the lid and actuator plate at their second raised configuration. In other embodiments, the struts may be arranged at an angle relative to the lid and the actuator plate at their second raised configuration. In some embodiments, the struts may move from a low profile configuration past a relatively perpendicular configuration to reach an angled configuration relative to the lid and the actuator plate. In some embodiments, the degree of compression of the lid against the vessel may be determined by one or more of the following properties of the system, including, but not limited to the flexibility and resilience of the struts, the gasket, and the various structural components, such as the channel walls.

In some embodiments, the trailing edge of the actuator plate may include a flange arranged at an angle (e.g., perpendicular from) its trailing edge. The flange may serve as a handle for the user to apply pressure and slide the cover into the vessel channel. Similarly, the flange may serve as a handle which the user may pull to extract the cover from the vessel channel. In some embodiments, the flange may serve as a stiffener to facilitate compressive load transfer across the channel. It should be appreciated that the operative forces required with the container systems of the present disclosure may be lower than those required by conventional container systems, allowing a greater number of users, even those with limited hand function, to utilize the systems. In some embodiments, the actuator plate of the cover may include an integral or distinct fenestrated extension, to mate with a similar fenestrated extension of the vessel, which may further facilitate one-handed operation of the container system.

In some embodiments, each strut may independently exert pressure between its respective segment of the lid and actuator plate. The localized pressure applied by the struts may allow the container to be sealed even if there are slight variations or irregularities in the manufacturing tolerances of the vessel channel.

In some embodiments, the cover may include a handle which may allow the user to readily hold and slide the cover into the vessel channel. The handle may be formed as part of one or more of the lid and the actuator plate. In some embodiments, the handle may include an opening, through which a user's fingers and/or thumbs may pass for improved ease of handling. The handle opening may also allow the cover to be hung or stored on a vertical surface (e.g., inside cabinet doors) to minimize its storage footprint. The vessel may be configured to be nested with other vessels to similarly minimize their storage footprint. Such a configuration would permit a neatly organized collection of container systems, while occupying relatively little cabinet space.

The container systems of the present disclosure may be formed of any suitable container materials. In some embodiments, the containers may be formed of food-safe materials for food storage. The outer facing materials of the container system may be formed of dishwasher-safe materials. In some embodiments, the materials of the container systems may not exhibit significant wear or damage when used in a cold setting (e.g., in a refrigerator or freezer) and/or in a hot or radiated setting (e.g., in a microwave). The material composition of any portion of the container system may be selected relative to the application. The vessel of the container system may be formed of any suitable material, such as glass, metal, plastics such as polypropylene. In some embodiments, a portion of the vessel (e.g., channel) may be formed of a moldable material, such as a plastic. In some embodiments, the entire vessel may be formed of the same material.

The various portions of the cover may be formed of one or more materials. For example, the living hinges of the struts may be formed of a robust and long-lasting material to facilitate hundreds or thousands of cycles of use without damage. In some embodiments, the lid and the actuator plate of the cover may be partially or entirely formed of an optically transparent or translucent material to allow the user to visualize the contents of the vessel without having to open the container. Other embodiments are contemplated which employ a lid and an actuator formed of an opaque material.

It should be appreciated that the container systems described herein may be used for any conventional container application, such as food storage, small item storage, supply storage, fluid storage, and/or any other suitable application. It should be appreciated that the container systems may be scaled to any suitable size, and may therefore accommodate any suitable contents which may or may not be categorized as small. Accordingly, the container systems of the present disclosure are not limited by the potential contents therein.

Turning to the figures, specific non-limiting embodiments are described in further detail. It should be understood that the various systems, components, features, and methods described relative to these embodiments may be used either individually and/or in any desired combination as the disclosure is not limited to only the specific embodiments described herein.

FIG. 1 shows an exploded view of a container system having a vessel 100 and a cover 200. The vessel 100 may include sidewalls 110 forming a cavity therein to receive food or items for storage. It should be appreciated that although a generally rectangular container is shown in FIG. 1, the container may have any suitable shape. In some embodiments, a channel 14 may be formed along an upper edge of the sidewalls 110. As shown in FIG. 1, the channel 14 may be formed along three of the four sidewalls of the vessel. Accordingly, a leading edge 6*a*/6*b* of the cover may be slid into the channel 14 through an opening formed at the fourth wall, may slide along the channel parallel to the lateral sidewalls, and may abut against the back end of the channel to seal the vessel, as described previously.

In some embodiments, the cover 200 may include an actuator plate 5, and a lid 4. The cover 200 may include a plurality of struts 10 arranged between the lid and the actuator plate, as shown in FIG. 1. In some embodiments, the struts 10 may be arranged along a periphery of the lid and the actuator plate. The central portion 201 of the lid and actuator may be optically transparent to allow a user to visualize the contents of the vessel. Embodiments in which the central portion is not transparent are also contemplated. For example, the struts may be arranged along the entire interface of the lid and actuator. In some embodiments, the central portion 201 of the actuator plate may not include any material, such that the lid 4 may be accessible through a hole formed in the actuator plate.

As described previously, the actuator plate 5 may include a flange 18 arranged at the trailing end of the cover. The flange 18 may serve as a stiffened handle for the user, a surface on which the user may apply pressure to close, or pull to open, the container system. In some embodiments, the flange may help inform the user of the orientation of the cover.

Figure 2:
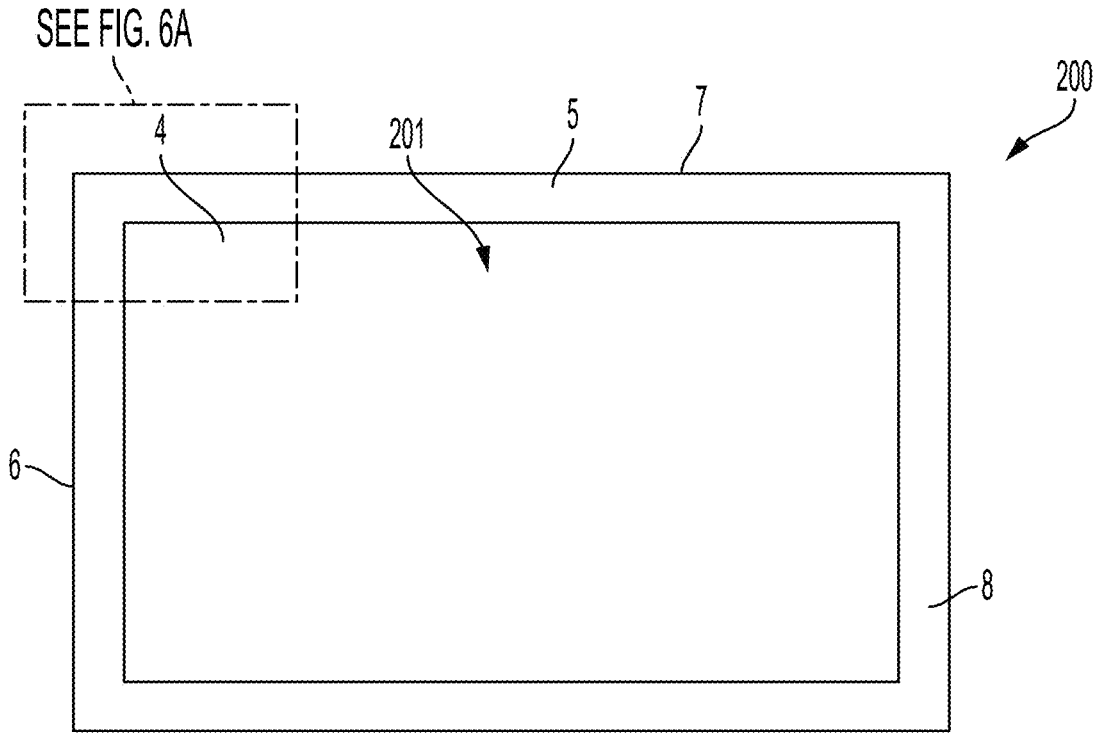
FIG. 2 shows a top-down plan view of a cover according to some embodiments.

FIG. 2 shows a top-down view of a cover 200 formed of an actuator plate 5 and lid 4, which may be visible through a central portion 201 of the actuator plate 5. The cover 200 may include a leading edge 6, which may be initially inserted into the channel 14 provided on the vessel. The cover 200 may then slide along the channel between its lateral sides 17 until a trailing edge 8 of the cover is arranged in the vessel channel. In some embodiments, the trailing edge 8 of the cover (or one of the lid and actuator of the cover) may include a handle to facilitate operation of the container system.

Figure 3:
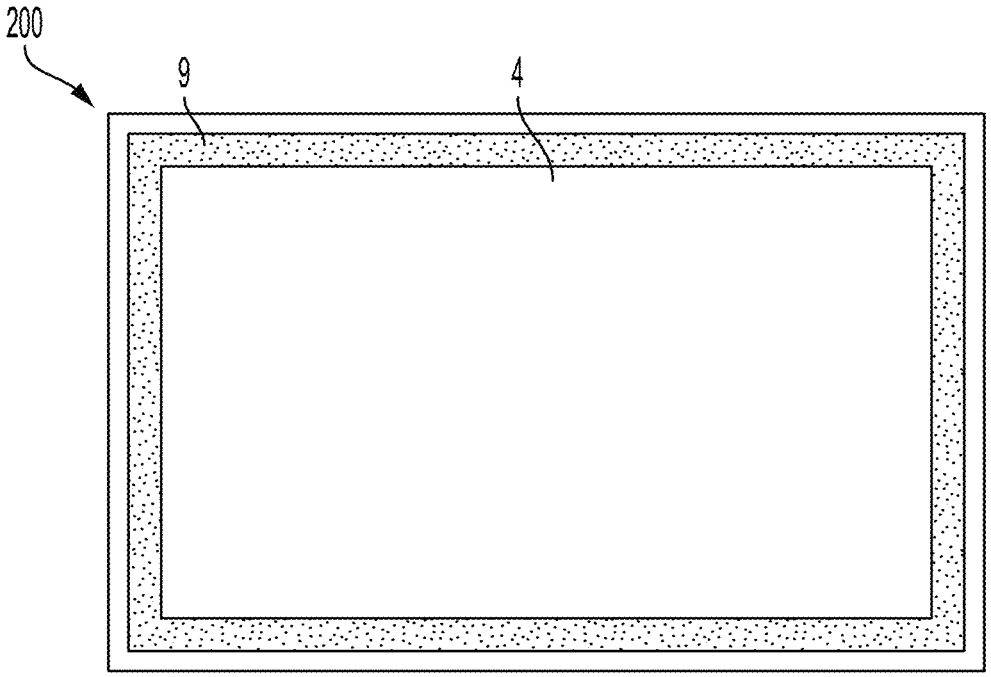
FIG. 3 shows a bottom-up plan view of the cover of FIG. 2.

FIG. 3 shows a bottom-up view of the cover 200 of FIG. 2. The bottom surface of the cover 200 may include a gasket 9 arranged around the periphery of the lid 4. As described earlier, a flexible gasket 9 may facilitate the sealing of the cover relative to a vessel. In some embodiments, the gasket may be formed of a rubber or silicone material. It should be appreciated that although the gasket is shown to span the entire peripheral edge of the lid 4, embodiments having segmented gaskets, or a gasket spanning a partial length of the peripheral edge of the lid, are also contemplated.

Figure 4:
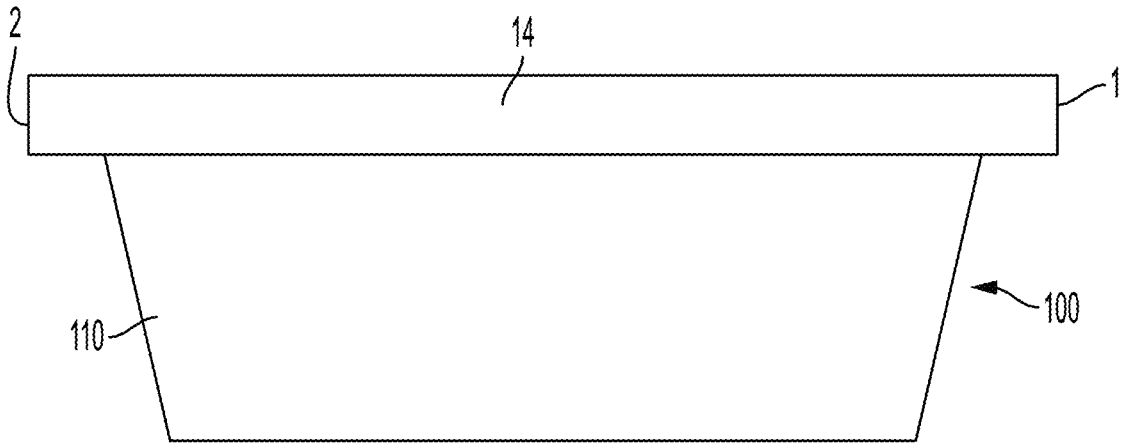
FIG. 4 shows a left-side elevation view of a container vessel according to some embodiments.

FIG. 4 shows a side view of the vessel 100 having a front edge 1 and a back edge 2. In some embodiments, the vessel 100 may have a channel 14, through which a cover may slide and subsequently seal the vessel. The channel 14 may extend along the sidewalls 110 of the vessel between the front edge 1 and the back edge 2. In some embodiments, the channel 14 may be open at the front edge 1 to allow a user to insert the cover into the channel.

Figure 5:
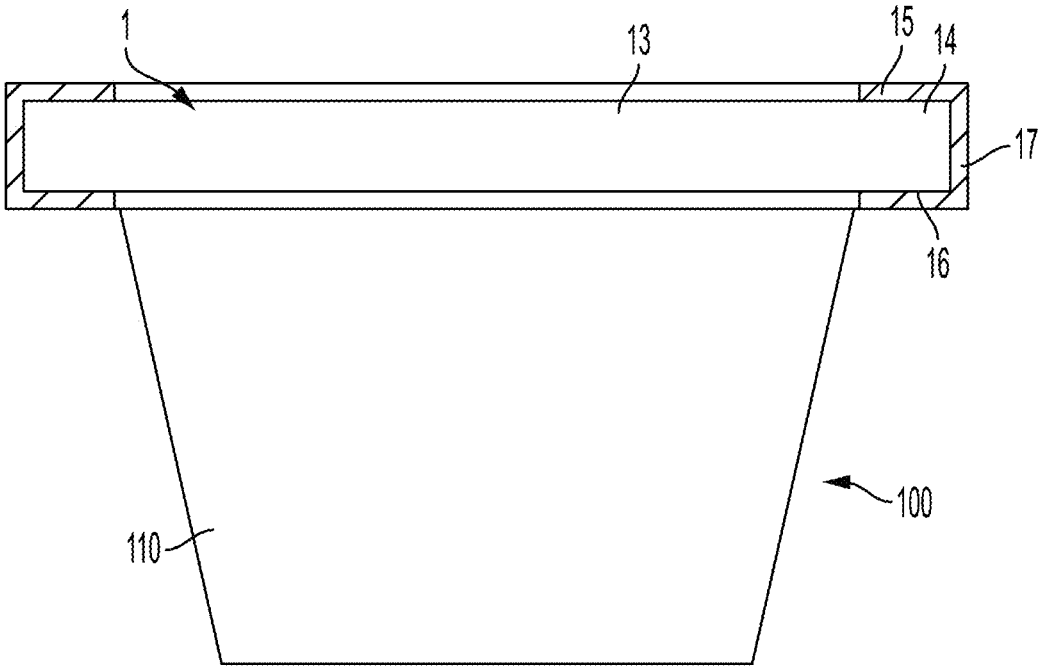
FIG. 5 shows a front-side elevation view of the container vessel of FIG. 4.

FIG. 5 shows the vessel 100 from the front edge of FIG. 4. The front edge of the vessel 100 may include a channel 14 forming a slot 13 through which a cover may be inserted. The channel 14 may include a lower wall 16, a side wall 17, and an upper wall 15 extending along both sidewalls 110 of the vessel, as well as the sidewalls of the back edge of the channel. The various walls of the channel 14 may prevent lateral and vertical dislodgement of the cover when inserted into the channel 14. It should be appreciated that although the channel is shown to be offset from the sidewalls 110 in FIG. 5, embodiments in which the channel is in line with or inset from the sidewalls are also contemplated.

Figure 6A:
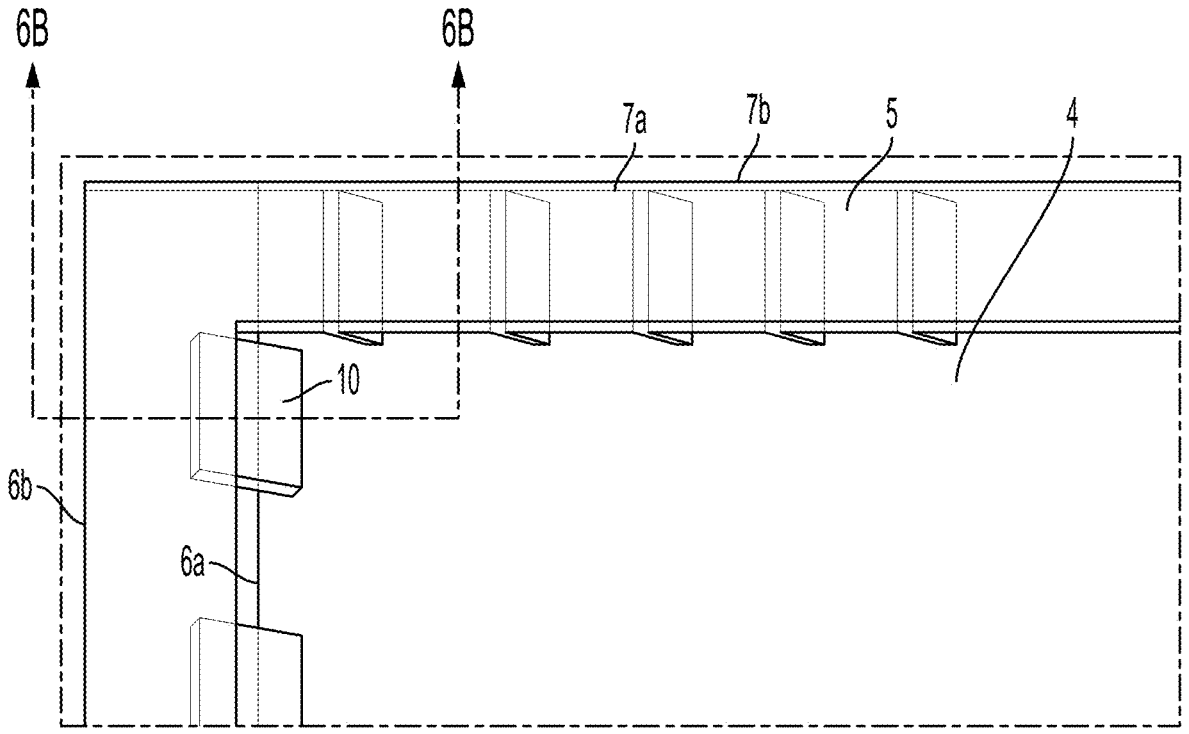
FIG. 6A shows a detailed view of FIG. 2.

FIG. 6A shows a close-up view of the cover of FIG. 2 along detail 6B. As shown, the cover may include a series of struts 10 arranged along a periphery between an actuator plate and a lid 4. The periphery may extend along the side edge 7*b* to the leading edge 6*a* of the actuator plate 5 and along the side edge 7*a* of the lid to the leading edge 6*b* of the lid 4.

Figure 6B:
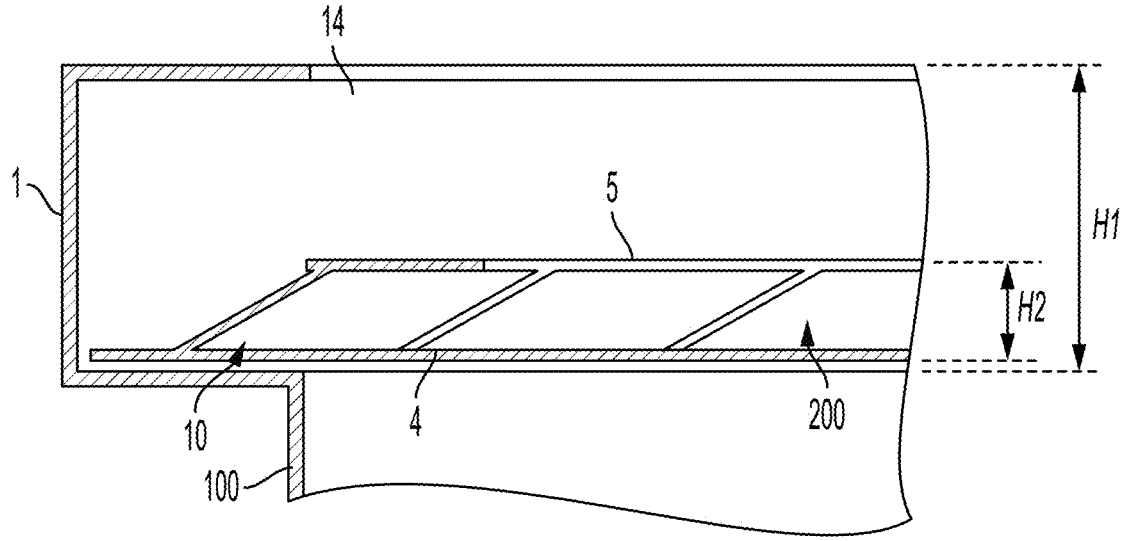
FIG. 6B shows a cross-section of FIG. 6A along line 6B-6B.

FIG. 6B shows a cross-sectional view of the cover of FIG. 6A taken along line 6B-6B. The cover 200 of FIG. 6B is shown arranged within a channel 14 of a vessel 100. FIG. 6B shows the cover in a low profile configuration, such that the height H2 of the cover is lower than the height H1 of the channel 14. In this way, the cover may be slid into and along the channel 14 of the vessel 100 without significant friction or traction between the lid and actuator and the channel sidewalls. In this configuration, the struts 10 of the cover are arranged at a small angle relative to the lid 4. In some embodiments, the struts may be substantially parallel to the lid while the cover is in process of sliding along the channel 14, although other non-parallel configurations of the struts are also contemplated.

As shown in FIG. 6B, due to the hinged connection between the actuator plate 5 and the lid 4 through the struts 10, when the struts 10 are arranged in a relatively low profile manner, the leading edge of the actuator plate 5 may be farther away from the front edge 1 of the channel relative to the leading edge of the lid 4.

Figure 7A:
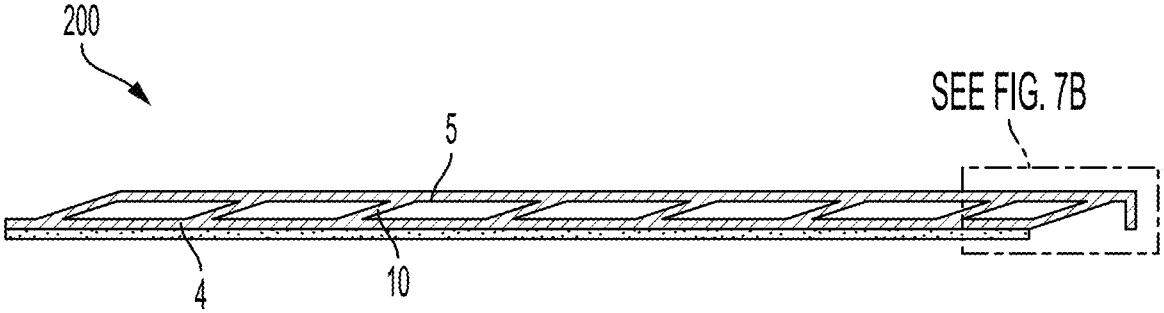
FIG. 7A shows a side elevation view of a cover according to some embodiments.
Figure 7B:
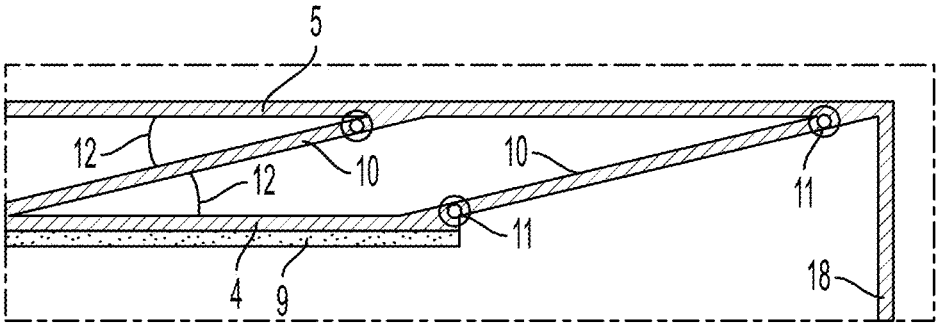
FIG. 7B shows a detailed view of FIG. 7A.

FIG. 7A shows a side view of a cover 200 according to some embodiments. The cover may be formed of an actuator plate 5 and a lid 4, connected by a plurality of struts 10. FIG. 7B shows a close-up view of FIG. 7A along detail 7B. In some embodiments, the cover may include a flange 18 at its trailing edge, which may serve as a handle for the user. The flange 18 may be formed as part of the actuator plate 5, as shown in FIG. 7B, the lid, or a combination of both the lid and the actuator plate.

As described previously, the cover may include a plurality of struts 10 connected to the lid and the actuator plate. In one embodiment, the struts may include flexible or living hinges 11 at the interface with the lid and the actuator plate, allowing the struts 10 to move between various compression angles 12. FIG. 7B shows the cover in a low profile configuration, such that the compression angle 12 between the struts and the lid 4 may be relatively low.

It should be appreciated that although struts having flexible living hinges are shown in the figures, other non-hinged alternatives are also contemplated. For example, the struts may be connected to the lid and actuator with pins, bearings, flexible joints, springs, and/or any other suitable connections to allow the struts to move between the various configurations described herein.

Figure 8A:
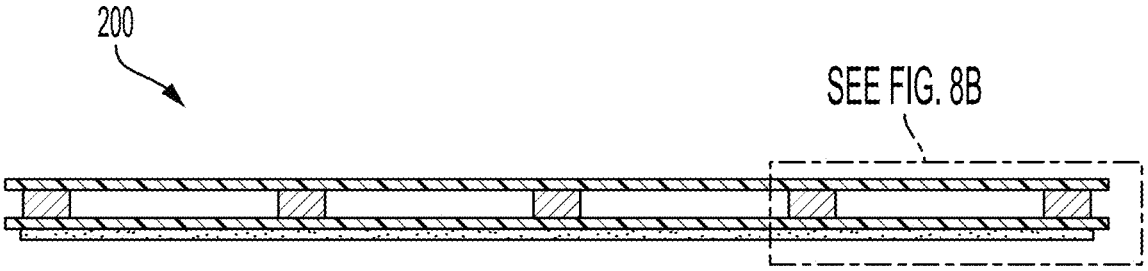
FIG. 8A shows a front-side elevation view of a cover according to some embodiments.
Figure 8B:
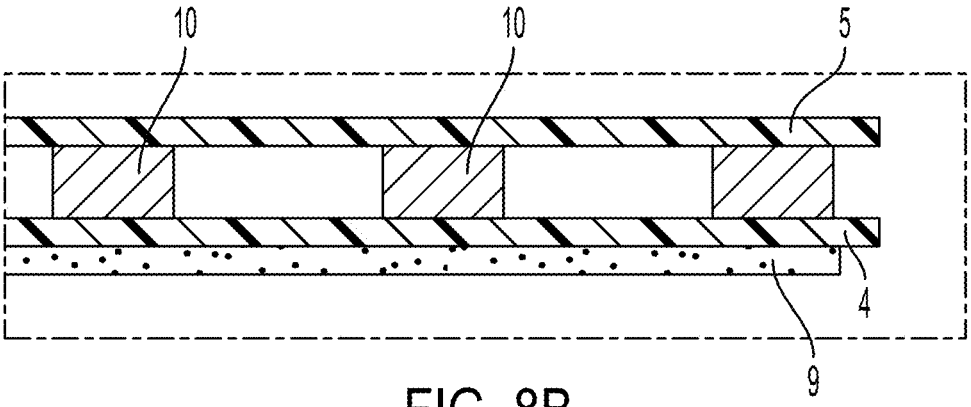
FIG. 8B shows a detailed view of FIG. 8A.

FIG. 8A shows a front view of a cover 200 according to some embodiments, extending between two lateral side edges of the cover. FIG. 8B shows a close-up view of FIG. 8A along detail 8B. In some embodiments, the struts 10 arranged between the actuator plate 5 and the lid 4 may be rectangular in shape, with hinged ends (see hinges 11 in FIG. 7B) which may be flexible, allowing the actuator plate to move in a longitudinal direction relative to the lid, within the range of motion of the struts 10. In some embodiments, the cover may include a gasket 9 to facilitate sealing between the cover and the vessel, as described previously.

Figure 9A:
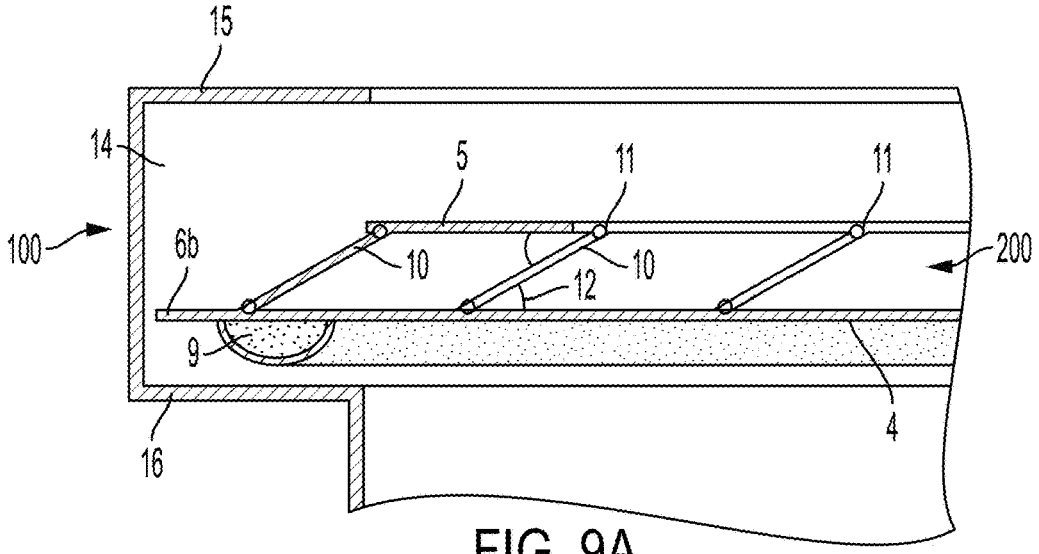
FIGS. 9A-9C show a closure arrangement of a container according to some embodiments.
Figure 9B:
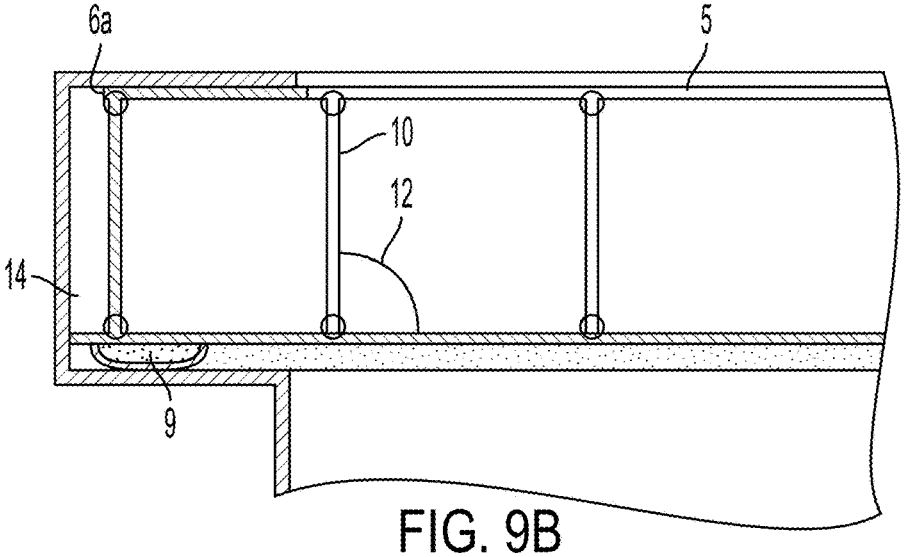
Figure 9C:
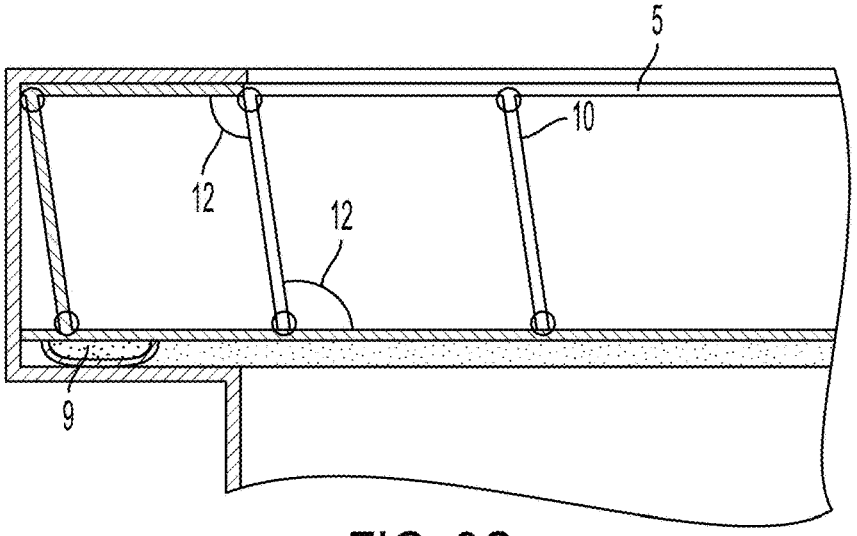

FIGS. 9A-9C show a partial cross-sectional view illustrating a closure procedure for a container system, according to some embodiments. A cover 200 of the container system may be inserted into a channel 14 of a vessel 100. During the initial stages of sliding the cover 200 into the channel 14, a series of struts 10 located between the lid 4 and the actuator plate 5 of the cover 200 may be arranged in a generally low profile configuration, as indicated by the low compression angle 12 shown in FIG. 9A.

As the cover slides along the channel 14, the leading edge 6*b* of the lid 4 may first abut against the back of the channel at the rear of the container system. At this point, the lid 4 may no longer be able to be translated longitudinally along the channel. Instead, any force applied to the cover may instead drive the actuator plate 5 toward the front edge of the channel. As shown in FIGS. 9A-9B, the actuator plate 5 may rise away from the lid in a vertical direction due to the struts 10 rotating around hinge points 11, increasing the compression angle 12. In some embodiments, the compression angle 12 may be approximately 90° relative to the lid 4, as shown in FIG. 9B. In some embodiments, the cover 200 may include a gasket 9 arranged beneath the lid 4 to engage the vessel. The gasket 9 may be compressed as the actuator plate moves vertically, allowing the cover to seal the vessel.

In some embodiments, the actuator plate 5 may be arranged offset from the lid 4, such that when the compression angle 12 of the struts is approximately perpendicular to the lid 4, the leading edge 6*b* of the lid 4 may abut the back edge of the channel while the leading edge 6*a* of the actuator plate 5 is still spaced from the channel. Accordingly, applying further pressure to the cover 200 may allow the actuator plate 5 to continue to move until it abuts against the channel back edge to help lock the cover in place, as shown in FIG. 9C. In this locked configuration, the compression angle 12 between the struts 10 and the lid 4 may be greater than 90°. In other words, the cover may pass through its maximal compression state (which may occur at a compression angle of 90°) and toward the configuration of FIG. 9C to help lock the cover. It should be appreciated that although a perpendicular configuration of the struts may be the maximal compression configuration of the cover, the configuration may be a relatively unstable equilibrium state, such that even a gentle retraction force may release the system from its compressed configuration and unseal the cover. Therefore, by passing beyond the maximal compression configuration, the user may need to apply greater force to intentionally release the cover from the vessel, reducing the risk of accidental unsealing of the system. In this manner, the cover may employ an over center arrangement to seal and lock the cover relative to the vessel.

It should be appreciated that the user may receive tactile feedback from the cover as the actuator plate 5 abuts against the channel wall, to ensure that the container system is properly sealed.

Figure 10A:
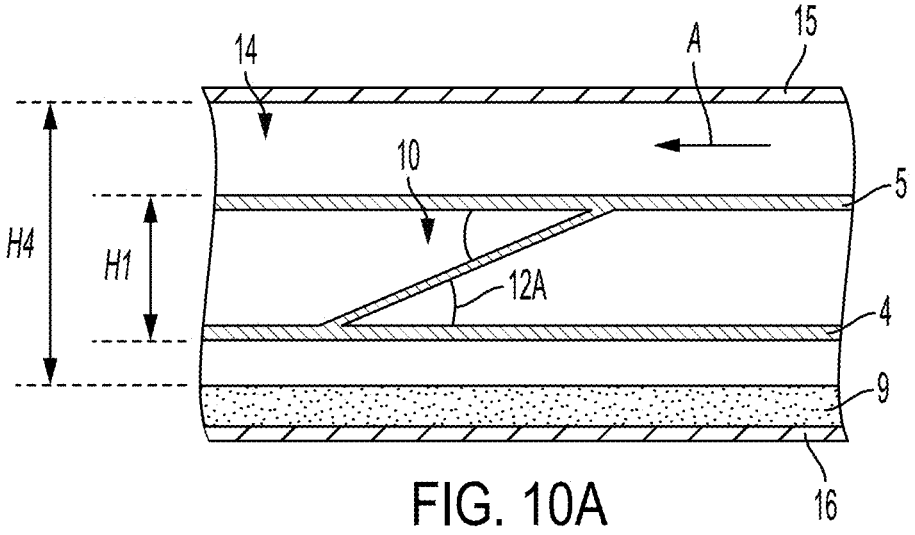
FIGS. 10A-10C show a closure arrangement of a container according to other embodiments.
Figure 10B:
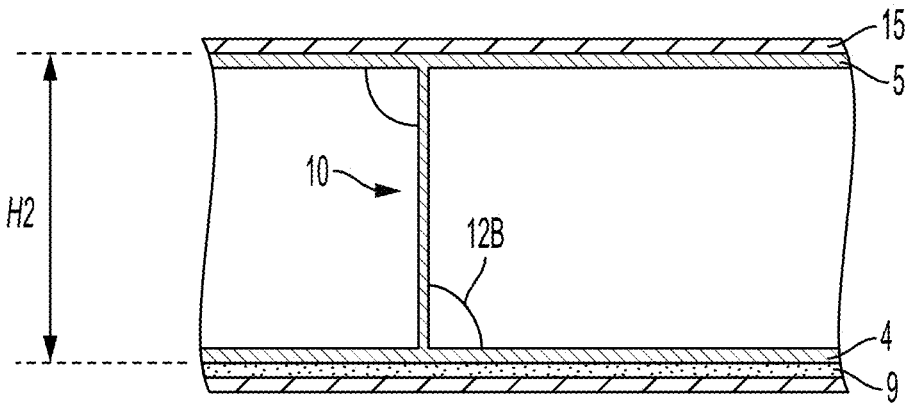
Figure 10C:
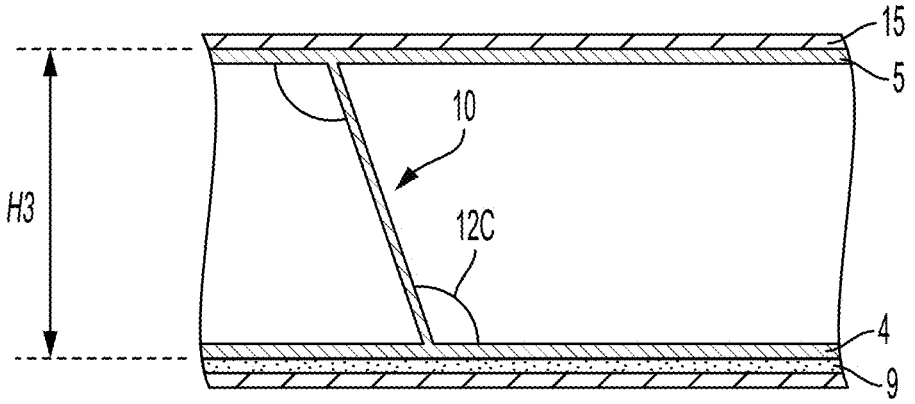

FIGS. 10A-10C show a partial cross-sectional view illustrating a closure arrangement for a container system, according to other embodiments. As shown in FIG. 10A, a cover having an actuator plate 5 and a lid 4 may be transversely slid into a channel 14 of a vessel, as indicated by arrow A. FIG. 10A shows the system in a preliminary stage in which the cover is not yet locked on the vessel. At such a stage, struts 10 positioned between the plate 5 and lid 4 may be arranged at an acute (<90°) angle 12A relative to the height-wise direction of the cover. Accordingly, the height H1 of the cover, determined by the distance between the actuator plate 5 and the lid 4, may be lower than the height H4 of the channel 14, defined by upper 15 and lower 16 walls. In this configuration, the actuator plate 5 may not significantly abut against the upper wall 15 of the channel, and the lid 4 may not significantly abut against a gasket 9, arranged on an upper surface of the lower wall 16 of the channel, such that the cover may be readily slid into the channel without significant friction.

As described previously, as the cover is slid into the channel, the lid 4 may first abut against an end wall of the channel, indicating that the cover is near the end of its travel. At this stage, represented by FIG. 10B, any additional force applied to the actuator may cause the actuator plate 5 to move relative to the lid 4, such that the struts 10 arranged in between, reflect over their pivot points. As shown, the struts 10 may be arranged at an angle 12B which may be substantially perpendicular to the plate 5 and lid 4. At the stage represented by FIG. 10B, a height H2 of the cover may be maximized relative to the channel height H4. In some embodiments, the gasket 9 may be compressed at the stage represented by FIG. 10B relative to the stage represented by FIG. 10A, to allow the cover to expand in a height-wise direction.

To further lock the cover to the vessel and reduce the likelihood of accidental dislodgement of the cover, any additional force applied to the actuator may allow the actuator plate 5 to reach the end of its travel, as shown in FIG. 10C. At this stage, the struts 10 may be arranged at an angle 12C which may be obtuse relative to the height-wise direction of the cover, as shown in FIG. 10C. The height H3 of the cover at this stage may be greater than the initial height H1 of the cover, from FIG. 10A, but less than the height H2 of the cover from FIG. 10B. Accordingly, the height of the gasket 9 in FIG. 10C may be higher than the height of the gasket 9 in FIG. 10B, given the slight relaxation of the cover relative to the channel. In some embodiments, a height-wise projection of the compressive force of the struts 10 may be greatest at the stage of FIG. 10B, lowest at the stage of FIG. 10A, and at a level between the greatest and lowest, at the stage of FIG. 10C. Thus, the cover may be stably locked to seal the vessel in FIG. 10C, without exhibiting the unstable equilibrium of the stage of FIG. 10B.

Figure 11A:
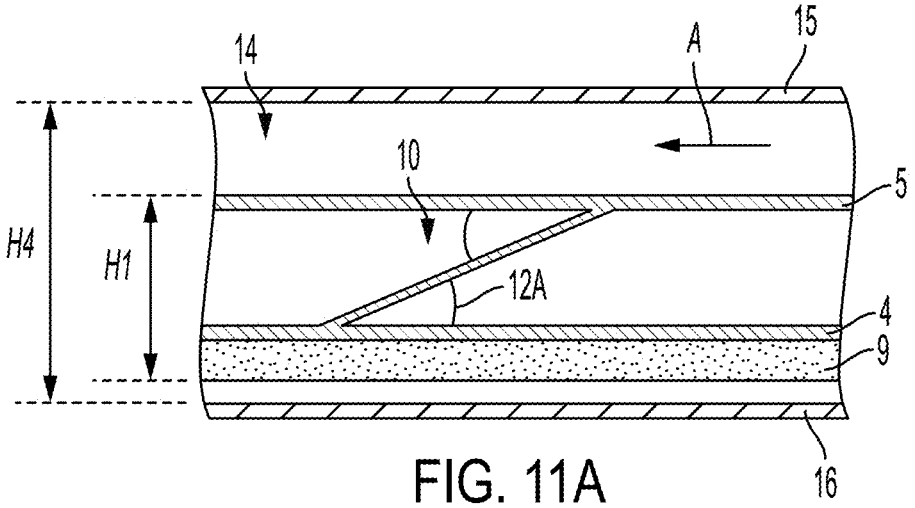
FIGS. 11A-11C show a closure arrangement of a container according to other embodiments.
Figure 11B:
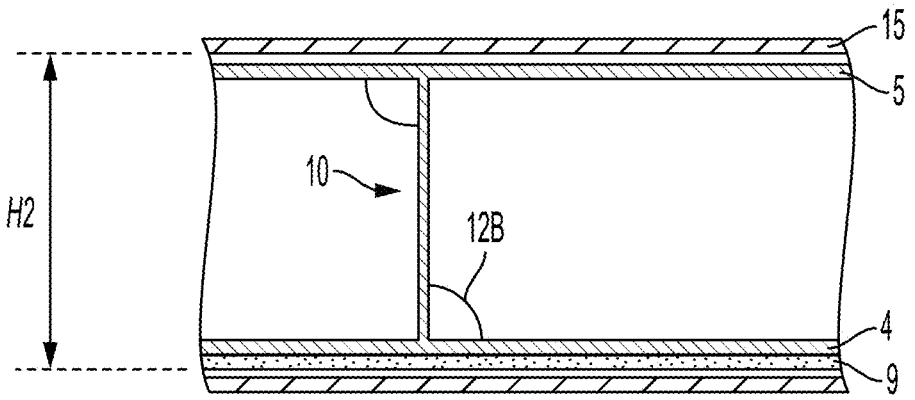
Figure 11C:
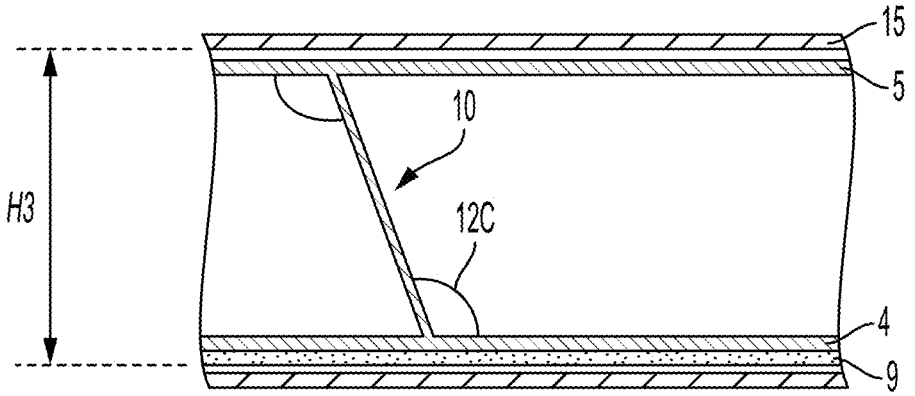

FIGS. 11A-11C show a partial cross-sectional view illustrating a closure arrangement for a container system, according to other embodiments. The embodiment of FIGS. 11A-11C may function similarly to the embodiment of FIGS. 10A-10C, except for the distinction that the gasket 9 may be provided on a lower surface of the lid 4 of the cover, as shown in FIGS. 11A-11C. Similarly to the process described previously, to lock a cover to a vessel, a user may first slide the cover into a channel 14 of the vessel while the cover is in a first configuration wherein a height H1 of the cover is less than a height H4 of the channel 14. In this configuration, the gasket 9 may not be substantially in contact with the lower wall 16 of the channel, and the actuator plate 5 of the cover may not be in contact with the upper wall 15 of the channel.

As the lid 4 reaches its end of travel, the struts 10 arranged between the lid 4 and the actuator plate 5 may transition to an intermediate configuration of FIG. 11B, wherein an angle 12B of the struts 10 relative to the height-wise direction of the lid 4 may be substantially perpendicular, rather than acute, at the stage represented by FIG. 11A. Accordingly, the gasket 9 may be compressed at the stage of FIG. 11B to have a height lower than the height of the gasket at FIG. 11A, accounting for compression of the gasket as the cover expands in a height-wise direction. As described earlier, as additional force is applied to the actuator, the actuator plate 5 may reach the end of its travel and abut against the channel, a process which results in a pivoting of the struts 10 to reach an angle 12C relative to the height-wise direction of the cover, as shown in FIG. 11C. In some embodiments, a height H3 of the cover at the locked configuration shown in FIG. 11C may be commensurate with the height H2 of the cover at the configuration of FIG. 11B. It should be appreciated that a height between the lid 4 and the actuator plate 5 may change between the configurations of FIGS. 11B to 11C, but that the height of the cover H1, H2, H3, which may be characterized from the actuator plate 5 to the gasket 9, may not significantly change between FIGS. 11B and 11C. Of course, the heights H2, H3 of the cover may be greater than the height H1 of the cover at the preliminary stage shown in FIG. 11A. In some embodiments, a height-wise projection of the compressive force of the struts 10 may be greatest at the stage of FIG. 11B, lowest at the stage of FIG. 11A, and at a level between the greatest and lowest, at the stage of FIG. 11C. Thus, the cover may be stably locked to seal the vessel in FIG. 11C, without exhibiting the unstable equilibrium of the stage of FIG. 11B.

Figure 12A:
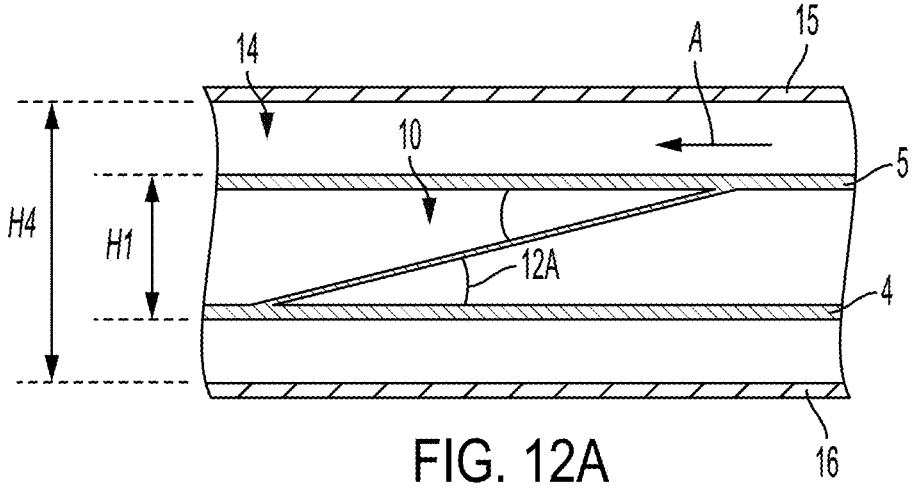
FIGS. 12A-12C show a closure arrangement of a container according to other embodiments.
Figure 12B:
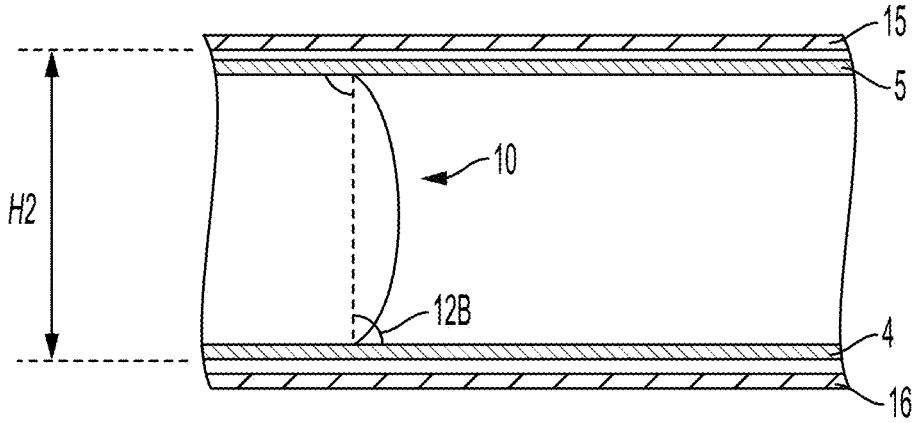
Figure 12C:
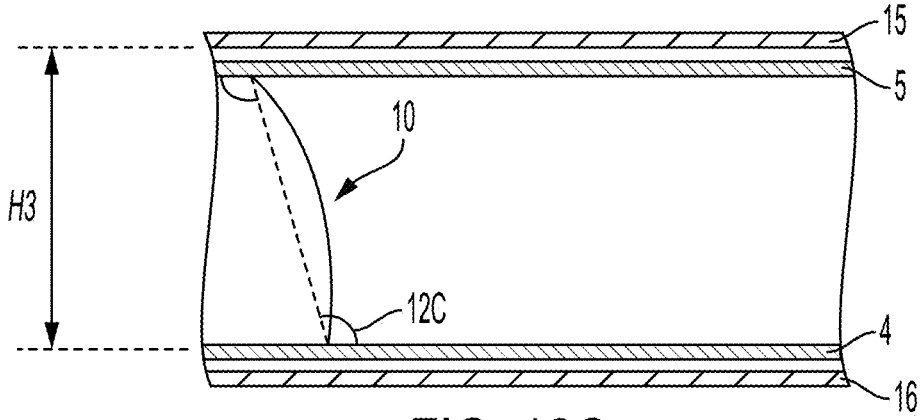

FIGS. 12A-12C show a partial cross-sectional view illustrating a closure arrangement for a container system, according to other embodiments. In the embodiments of FIGS. 12A-12C, the container system may not employ a gasket between the cover and the channel; rather, sealing is effected by direct contact of the lid against the channel. In such embodiments, the struts 10 may be sufficiently flexible such that they may buckle when compressed along their axial direction. FIG. 12A depicts a cover having a lid 4 and actuator plate being slid into the channel 14 in a relaxed configuration, wherein a height H1 of the cover may be lower than the height H4 of the channel. FIG. 12B depicts the system when the lid 4 has reached the end of its travel. In such configurations, the height H2 of the cover may be commensurate with the height H4 of the channel. To accommodate this maximal height of the cover, while the struts are arranged at an angle 12B perpendicular to the lid 4 and actuator plate 5, the struts 10 may buckle, as shown in FIG. 12B. In this regard, the struts may be configured to have a length which is greater than the height of the channel prior to buckling.

In some embodiments, as a user continues to apply pressure to the actuator to lock the cover to the vessel, the actuator plate 5 may reach the end of its travel, allowing the struts 10 to relax in FIG. 12C, relative to their configuration of FIG. 12B. It should be appreciated that the height H2 of the cover at the configuration of FIG. 12B may be commensurate with the height H3 of the cover of FIG. 12C, both of which may be commensurate with the channel height H4, as shown in FIG. 12A.

In some embodiments, a height-wise projection of the compressive force of the struts 10 may be greatest at the stage of FIG. 12B, lowest at the stage of FIG. 12A, and at an intermediate level between the greatest and lowest which is sufficient to seal the lid against the vessel, at the stage of FIG. 12C. Thus, the cover may be stably locked to seal the vessel in FIG. 12C, without exhibiting the unstable equilibrium of the stage of FIG. 12B. Accordingly, although the struts 10 may be buckled in the configurations of FIGS. 12B and 12C, the degree of buckling may be greater at the configuration of FIG. 12B compared to the configuration of FIG. 12C. It should be appreciated that the buckling capacity of the struts 10 described relative to FIGS. 12A-12C may serve as a compressible component to facilitate maintaining a maximal height of the cover relative to the channel height. In some embodiments, the buckling struts of FIGS. 12A-12C may be used in conjunction with a gasket arranged either on the bottom surface of the lid or on an upper surface of the lower wall of the channel.

Figure 13:
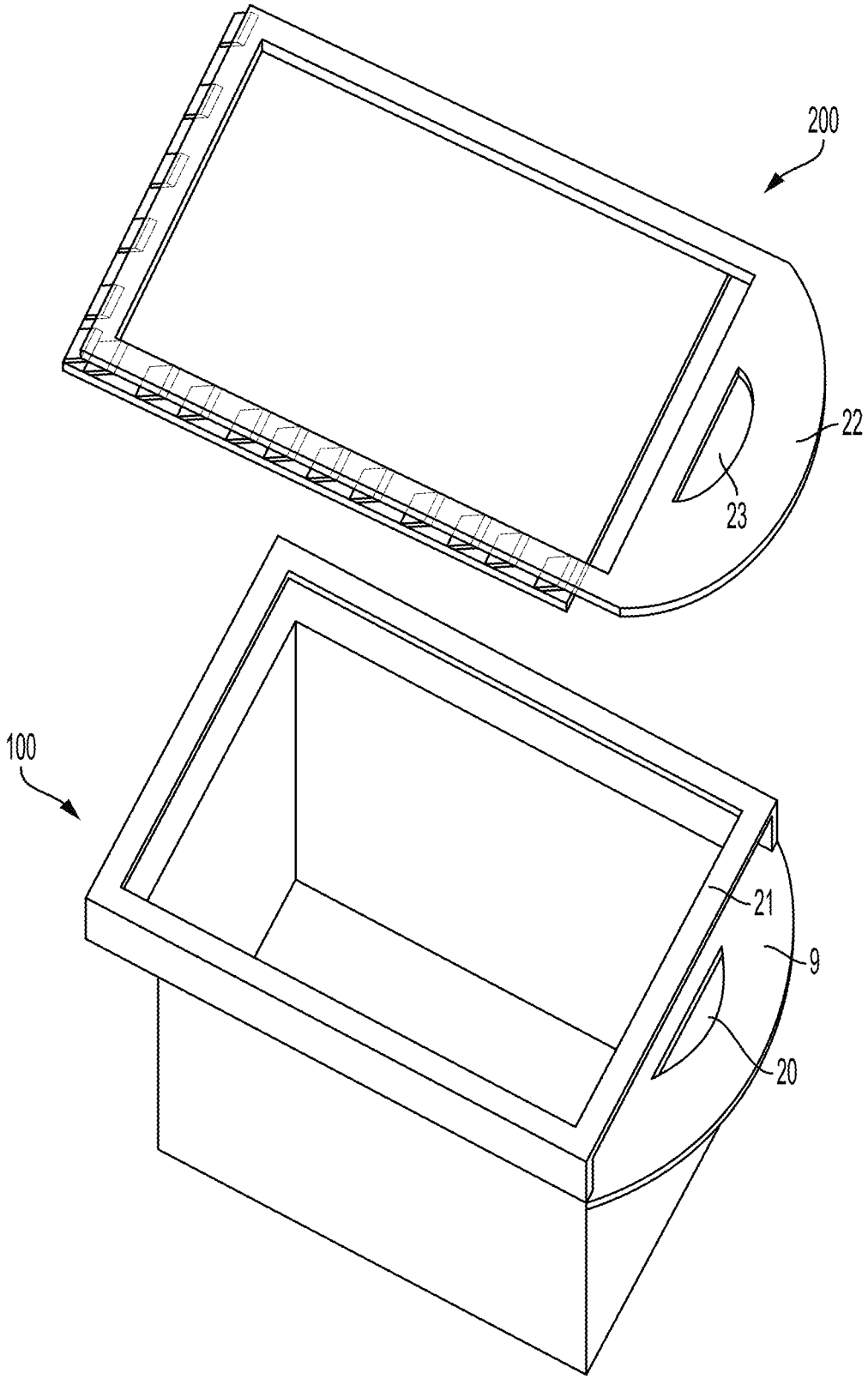
FIG. 13 shows an exploded view of a container system according to some embodiments.

FIG. 13 shows an exploded view of a container system having a cover 200 and a vessel 100. In some embodiments, the trailing edge of the cover 200 may include a handle 22 to allow a user to operate the cover 200. As described previously, in some embodiments, the handle 22 may include an opening 23, through which a user may grasp the handle. The cover 200 may be arranged within a channel of the vessel 100, such that the handle 22 of the cover 200 may be aligned with the handle 19 of the vessel. Similar to the handle of the cover, the handle 19 of the vessel may include an opening 20, which the user may grasp to help seal or unseal the cover from the vessel. In some embodiments, the handles of the cover and vessel may be used to help hang the container system when not in use. It should be appreciated that any suitable ergonomic shape or arrangement of handles and openings may be employed for the container systems described herein.

In some embodiments, the upper surface of the channel of the vessel 100 may include a compression bar 21 to help guide the cover 200 into the channel. In some embodiments, the compression bar may serve as a structural member to carry compression forces across the opening of the channel between the two sides of the channel. In some embodiments, the compression bar may include a handle and an opening which may be aligned with the handle and opening of the actuator plate when the container system is effectively sealed. The presence of a handle connected to (or integrally formed with) the front of the vessel below the compression bar may further facilitate one-handed operation, although the container system may also be operated in a one-handed fashion without a compression bar handle. Embodiments without a compression bar are also contemplated.

Figure 14:
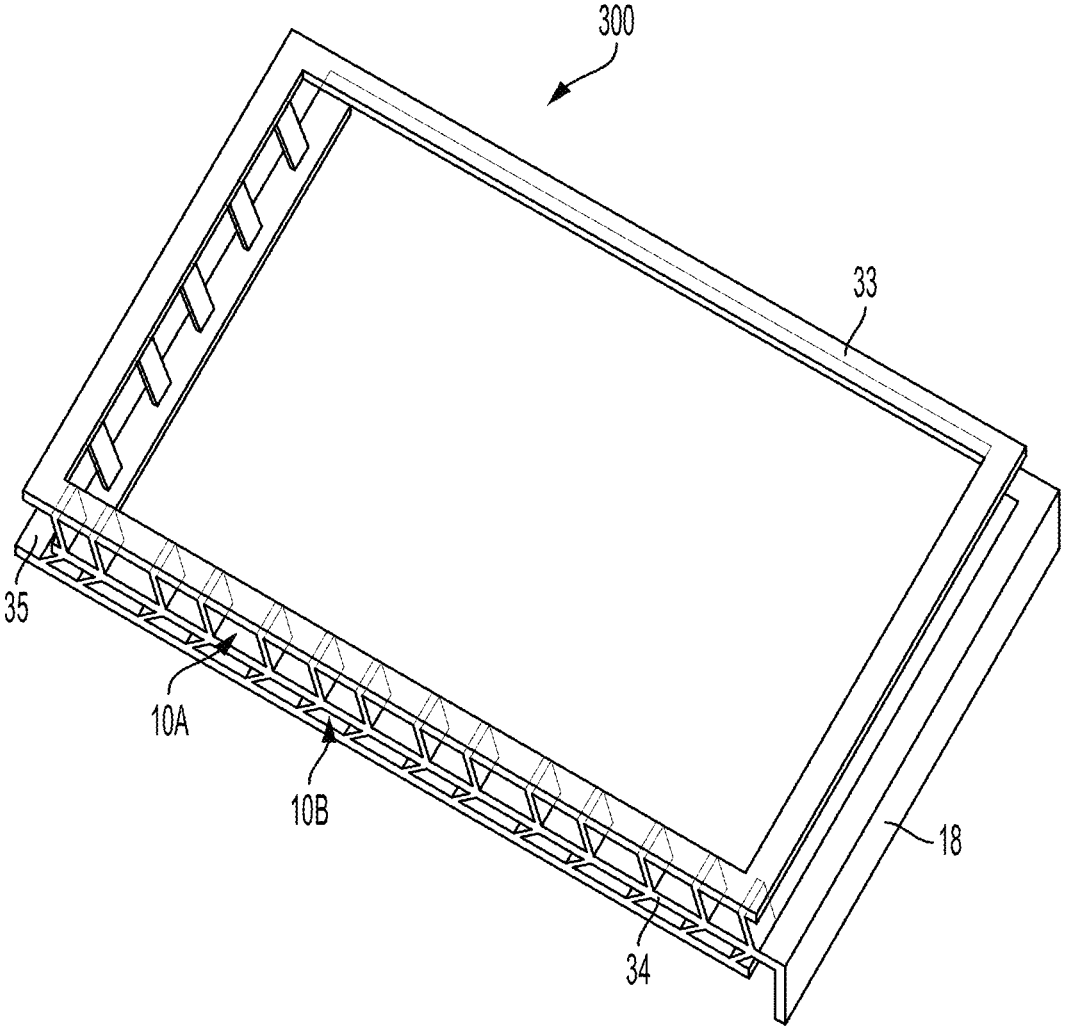
FIG. 14 shows a cover according to some embodiments.

FIG. 14 shows a cover 300 according to some embodiments. The cover 300 may include a lid 35 and an actuator which includes an upper plate 33 and a middle plate 34. The middle plate 34 may serve as the actuator plate of the cover 300, as will be described in greater detail below. The cover 300 may also include two sets of struts, a first set of struts 10A arranged between the actuator upper plate 33 and the middle plate 34, and a second set of struts 10B arranged between the middle plate 34 and the lid 35. The struts may be hinged between the respective bodies (e.g., lid 35, upper actuator plate 33, middle actuator plate 34), such that they may be able to rotate around their hinged connection points. In some embodiments, the middle plate 34 may include a flange 18 at its trailing end to serve as a handle for operating the cover.

Figure 15A:
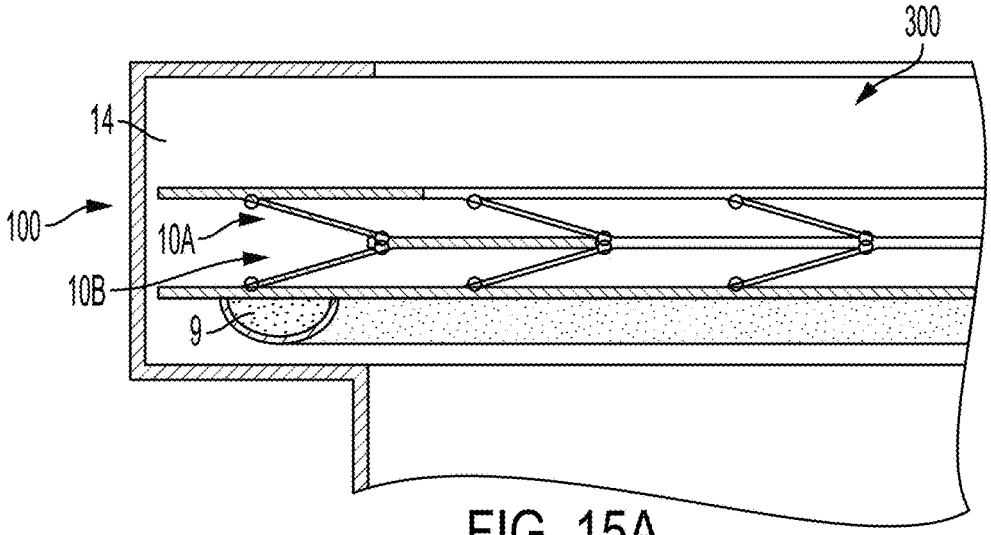
FIGS. 15A-15C show a closure arrangement of the cover of FIG. 14 according to some embodiments.
Figure 15B:
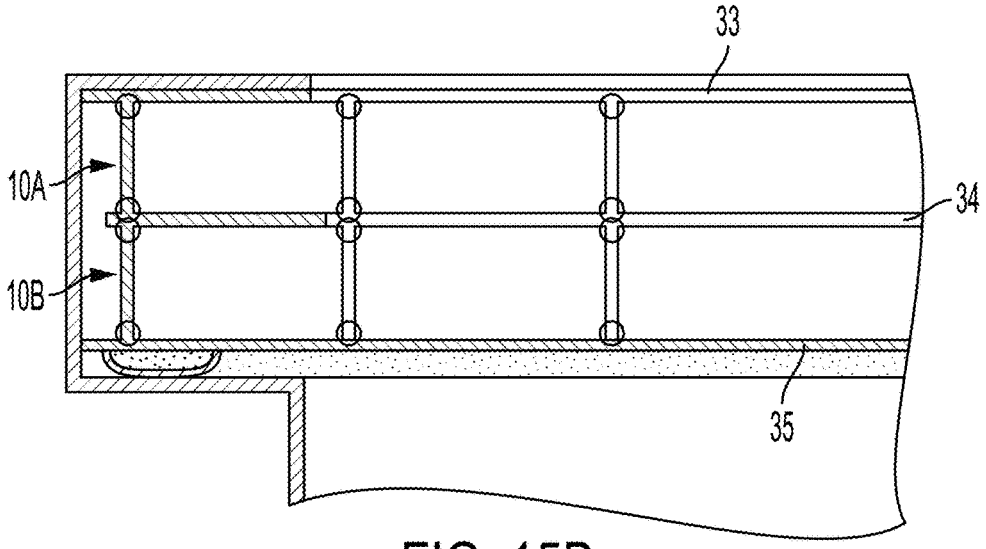
Figure 15C:
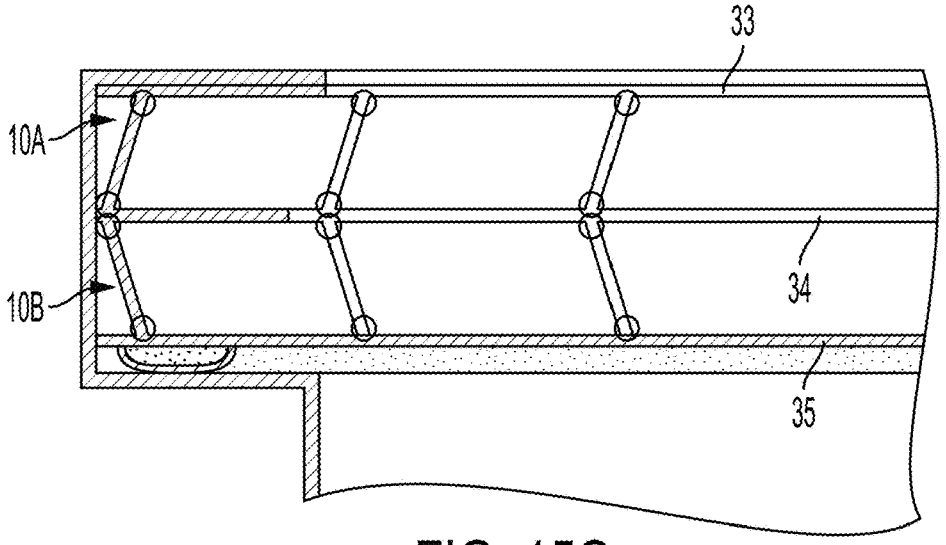

FIGS. 15A-15C show a partial cross-sectional view of a closure procedure for a cover 300 arranged within a channel 14 of a vessel 100. At the initial stages of closure, the cover 300 may be inserted into the channel 14 in a low profile configuration, such that the height of the cover may be lower than a height of the channel, as shown in FIG. 15A. The difference in height may facilitate the sliding of the cover into and along the channel.

As the cover 300 slides into the channel 14, the leading edges of the upper actuator plate 33 and the lid 35, which may be aligned, may initially abut against the channel edge at the end of their travel along the channel, as shown in FIG. 15B. Additional force applied to the cover (e.g., through the flange or handle) advances the middle actuator plate, which is initially offset from the lid and the upper actuator plate, longitudinally along the channel to drive the upper actuator plate 33 and the middle actuator plate 34 apart from each other and the lid within the channel. As described relative to cover 200, the middle actuator plate 34 may continue to traverse along the channel, past the point of maximal compression (see perpendicular struts in FIG. 15B) to reach the channel edge, as shown in FIG. 15C, effectively sealing and locking the cover 300 in place relative to the vessel channel 14. As described previously, this locking arrangement may allow the user to seal the cover on to the vessel with a low risk of accidental dislodgement. A user may release the seal of the container system through intentional pulling force applied to the handle or flange.

As previously described relative to the cover 200, the cover 300 may also include a flexible gasket 9, which may serve to enhance the seal between the lid and the vessel. As shown in FIGS. 15A-15C, the gasket may be compressed between the cover and the channel as the cover height increases.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present Invention.

What is claimed is:

1. A container system comprising:

a vessel having an internal cavity formed by a plurality of sidewalls, the vessel including a top edge along at least some of the plurality of sidewalls; and a cover including a first end, a second end and first and second side portions extending in a longitudinal direction from the first end to the second end, the first and second side portions configured to be slidably received along the top edge of the vessel in the longitudinal direction, the cover configured to transition between a first configuration and a second configuration to seal the cover against the vessel, wherein the cover has a first height along the first and second side portions in the first configuration and a second height along the first and second side portions in the second configuration, the first height being less than the second height.

2. The container system of claim 1, wherein the vessel includes a channel located along at least a portion of the top edge, the cover configured to be longitudinally slid along the channel of the vessel.

3. A container system of claim 1, comprising:

a vessel having an internal cavity formed by a plurality of sidewalls, the vessel including a top edge along at least some of the plurality of sidewalls; and a cover configured to be slidably received along the top edge of the vessel, the cover configured to transition between a first configuration and a second configuration to seal the cover against the vessel, wherein the cover has a first height in the first configuration and a second height in the second configuration, the first height being less than the second height, wherein the cover is configured to transition between the second configuration and a third configuration to maintain the seal between the cover and the vessel, wherein the cover has a third height in the third configuration which is less than the second height of the cover in the second configuration, and wherein the third height of the cover in the third configuration is greater than the first height of the cover in the first configuration.

4. A container system comprising:

a vessel having an internal cavity formed by a plurality of sidewalls, the vessel including a top edge along at least some of the plurality of sidewalls; and a cover configured to be slidably received along the top edge of the vessel, the cover configured to transition between a first configuration and a second configuration to seal the cover against the vessel, wherein the cover has a first height in the first configuration and a second height in the second configuration, the first height being less than the second height, wherein the cover comprises:

a lid; and an actuator, the actuator including at least one actuator plate and a first plurality of struts arranged along at least a periphery of a space formed between the at least one actuator plate and the lid, wherein the first plurality of struts are coupled to each of the lid and the at least one actuator plate.

5. The container system of claim 4, wherein the first plurality of struts are coupled to the lid and the at least one actuator plate through hinges.

6. The container system of claim 4, wherein the at least one actuator plate is longitudinally offset from the lid when the cover is in the first configuration.

7. The container system of claim 4, wherein the at least one actuator plate is approximately aligned with the lid when the cover is in the second configuration.

8. The container system of claim 1, wherein the cover includes a gasket located at a bottom surface thereof.

9. The container system of claim 2, wherein the channel of the vessel includes a gasket located at an inner bottom surface thereof.

10. A container system comprising:

a vessel having an internal cavity formed by a plurality of sidewalls, the vessel including a top edge along at least some of the plurality of sidewalls; and a cover including first and second ends and having a length from the first end to the second end, the cover configured to be slidably received lengthwise along the top edge of the vessel, the cover configured to transition between a first configuration and a second configuration along the entire length thereof in response to the transverse movement of the cover along the top edge of the vessel to seal the cover against the vessel.

11. The container system of claim 10, wherein the cover has a first height in the first configuration and a second height in the second configuration, the first height being less than the second height.

12. The container system of claim 10, wherein the vessel includes a channel located along at least a portion of the top edge, the cover configured to be longitudinally slid along the channel of the vessel.

13. A container system comprising:

a vessel having an internal cavity formed by a plurality of sidewalls, the vessel including a top edge along at least some of the plurality of sidewalls; and a cover configured to be transversely slidably received along the top edge of the vessel, the cover configured to transition between a first configuration and a second configuration in response to the transverse movement of the cover along the top edge of the vessel to seal the cover against the vessel, wherein the cover has a first height in the first configuration and a second height in the second configuration, the first height being less than the second height, wherein the cover is configured to transition between the second configuration and a third configuration to maintain the seal between the cover and the vessel, wherein the cover has a third height in the third configuration which is less than the second height of the cover in the second configuration, and wherein the third height of the cover in the third configuration is greater than the first height of the cover in the first configuration.

14. A container system comprising:

a vessel having an internal cavity formed by a plurality of sidewalls, the vessel including a top edge along at least some of the plurality of sidewalls; and a cover configured to be transversely slidably received along the top edge of the vessel, the cover configured to transition between a first configuration and a second configuration in response to the transverse movement of the cover along the top edge of the vessel to seal the cover against the vessel, wherein the cover comprises:

a lid; and an actuator, the actuator including at least one actuator plate and a first plurality of struts arranged along at least a periphery of a space formed between the at least one actuator plate and the lid, wherein the first plurality of struts are coupled to each of the lid and the at least one actuator plate.

15. The container system of claim 14, wherein the at least one actuator plate includes a middle actuator plate and an upper actuator plate; and wherein the actuator includes a second plurality of struts are arranged along at least a periphery of a space formed between the upper actuator plate and the middle actuator plate, the first plurality of struts being located between the middle actuator plate and the lid.

* * * * *